US005540443A

United States Patent [19]

Ballan et al.

[11] Patent Number: 5,540,443

[45] Date of Patent: Jul. 30, 1996

[54] PORTABLE CORRUGATED CARDBOARD GAME BOARD

[76] Inventors: Laurinda Ballan, 215 Lafayette Ave., Cliffside Park, N.J. 07010; Domenic Palamenti, 575 N. Midland Ave., Box #512, Saddle Brook, N.J. 07662; Joseph Giasi, 20 W. Park Ave., Long Beach, N.Y. 11561

[21] Appl. No.: 414,953

[22] Filed: Mar. 31, 1995

[51] Int. Cl.[6] ..... A63F 3/00

[52] U.S. Cl. ..... 273/285

[58] Field of Search ..... 273/242, 243, 273/236, 285, 287

[56] References Cited

U.S. PATENT DOCUMENTS

| | | | |
|---|---|---|---|
| 827,670 | 7/1906 | Russell | 273/285 |
| 1,535,503 | 4/1925 | Spaeder | 273/285 |
| 1,558,690 | 10/1925 | McCollom | 273/285 X |
| 1,641,104 | 8/1927 | Solod | 273/285 |
| 2,221,267 | 11/1940 | Robertson | 273/285 |
| 2,284,242 | 5/1942 | Ziemmerman | 273/285 |
| 3,346,259 | 10/1967 | Froehlig | 273/285 |
| 3,458,216 | 7/1969 | Harrison | 273/285 X |
| 3,995,704 | 12/1976 | Blickman | 273/285 X |
| 4,371,168 | 2/1983 | Dupuis | 273/285 X |
| 5,362,063 | 11/1994 | Cummings | 273/285 X |

*Primary Examiner*—William E. Stoll

[57] ABSTRACT

A corrugated cardboard game board hinged at a central location so that in transit or when stored prior to use, it is of a convenient half-size, wherein the embodiment of the hinge uses to advantage the corrugated cardboard construction material by cutting only the playing surface upper paper ply and down through the flutes to the depth of the lower paper ply which is left intact, with the result that the board hinges about a fold in the lower paper ply at the site of the cut made in the cardboard.

2 Claims, 2 Drawing Sheets

PORTABLE CORRUGATED CARDBOARD GAME BOARD

The present invention relates generally to a game board of adequate size to be used for the purposes intended, and adapted to be reduced one-half in size for more convenient handling and portability, and more particularly to the embodiment of a novel hinge in the game board resulting in the noted full size and half size use.

EXAMPLES OF THE PRIOR ART

Game boards with embodied hinges to allow for size reduction are already generally well known, as exemplified by U.S. Pat. Ser. No. 297,219 issued to Anthony on Apr. 22, 1984, by U.S. Pat. No. 1,851,600 issued to Stanley on Mar. 29, 1932, and by U.S. Pat. No. 5,262,063 issued to Cummings on Nov. 18, 1994, all of which use a metal or so-called "piano" hinge to achieve the desired size reduction.

In lieu of metal "piano" hinges, tapes are used to hinge together game board panels in U.S. Pat. No. 330,990 issued to Lundstedt on Nov. 24, 1885, in U.S. Pat. No. 3,069,168 issued to Feldman et al. on Dec. 18, 1962, and in U.S. Pat. No. 3,458,216 issued to Harrison on Jul. 29, 1969.

In contrast, the construction material selected for the within game board is corrugated cardboard and it is the primary object of the present invention to use to advantage this construction material in providing a hinge overcoming the foregoing and other shortcomings of the prior art.

More particularly, it is an object to hinge the within game board eschewing the use of any additional hinge devices, whether made of metal, tape or otherwise, and instead using only the cardboard construction material, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 2:
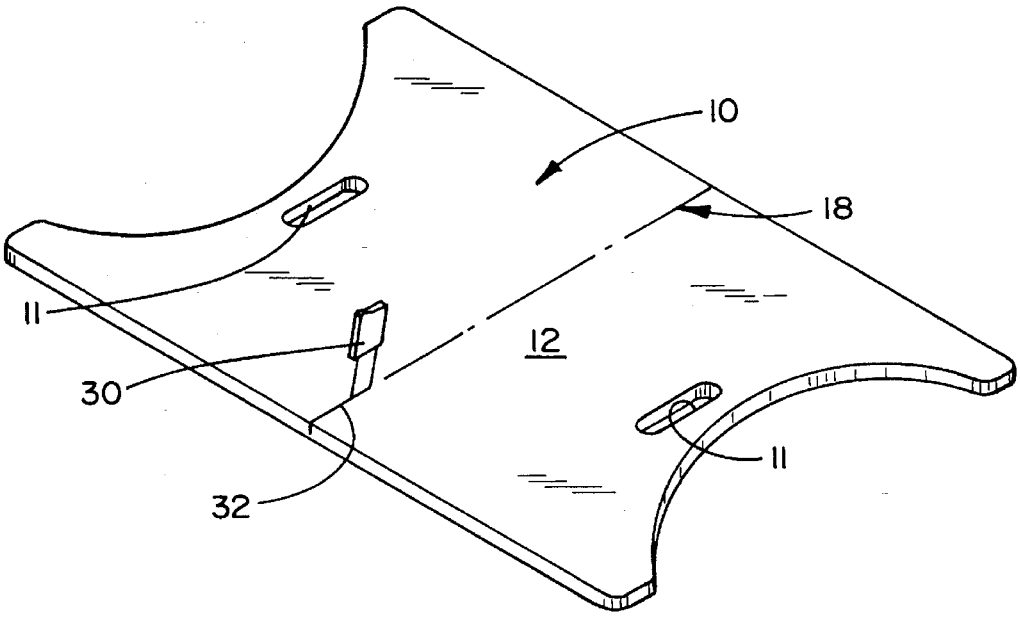
FIG. 2 is a perspective view of the game board as die cut from the corrugated cardboard FIG. 1 substrate.
Figure 4:
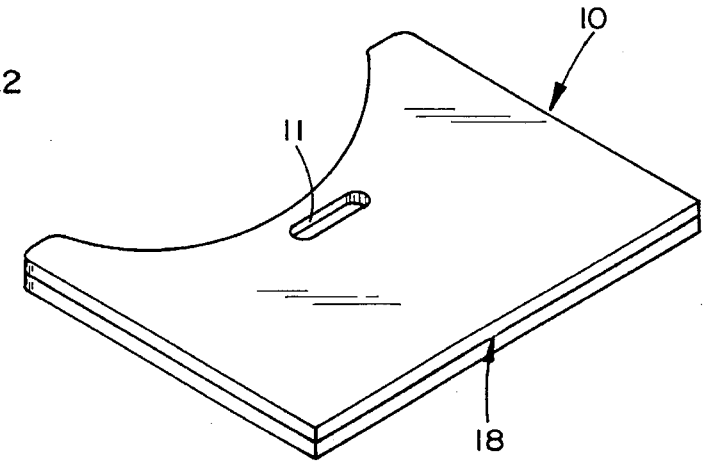
FIG. 4 is a perspective view of the game board folded in half about the hinge of FIG. 3 to contribute to a compact storage condition and convenience in the transport thereof.
Figure 5:
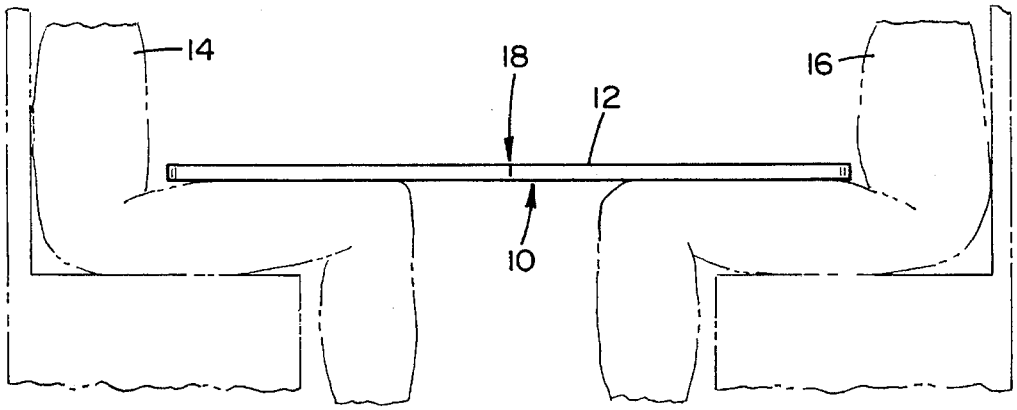
FIG. 5 is a side elevational view of the unfolded game board of FIG. 4 shown in solid line perspective in a typical use supported on the laps of seated game board users shown in phantom perspective.

Shown in the drawings is a generally rectangular game board 10 which for the purposes intended, has a width A of preferably 24 inches and a length B of 36 inches to present an adequate playing surface 12 between two users 14 and 16, as best shown in FIGS. 2 and 5. For storage and portability, game board 10 is reduced to half its FIG. 5 size, as shown in FIG. 4, as a favorable consequence of being embodied with a hinge 18, shown generally in FIGS. 2 and 4, and in more detail in FIG. 3 and, more particularly, as a consequence of the selection of corrugated cardboard as the construction material for the game board 10.

Figure 1:
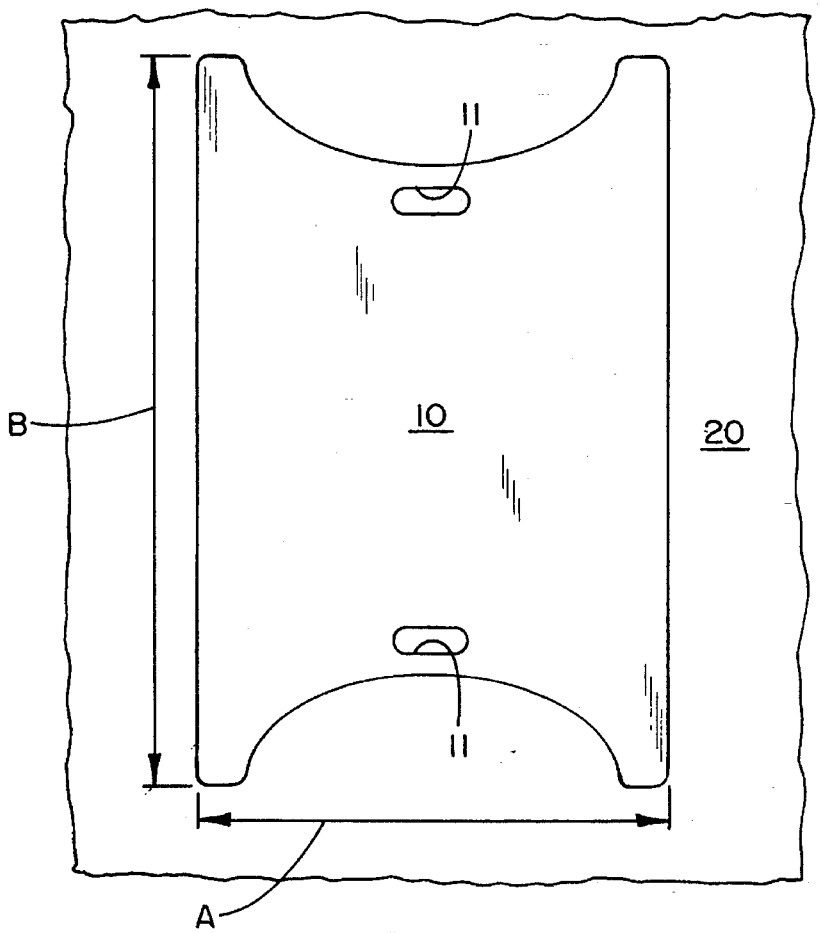
FIG. 1 is a plan view of a corrugated cardboard substrate having delineated thereon the outline of the within inventive game board.
Figure 3:
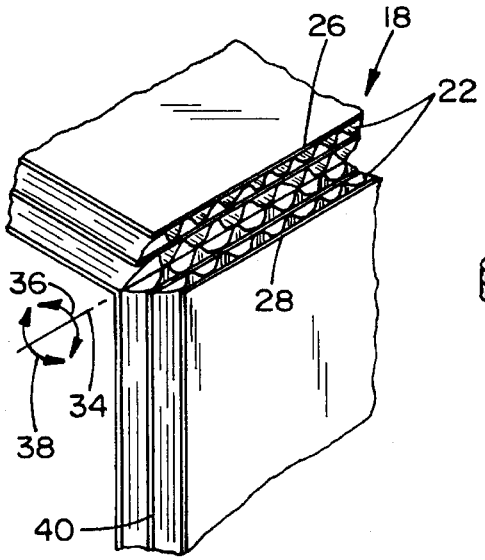
FIG. 3 is a partial perspective view, on an enlarged scale, of a hinge embodied in the game board.

That is, and as best shown in FIGS. 2 and 3, underlying the present invention is the recognition that corrugated cardboard as die cut from the FIG. 1 substrate 20 which is comprised of this material, provides an initial work-in-process blank consisting of undulated flutes 22 adhesively secured at the cusps 24 of the flutes along butting adjacent edges 26 and 28 and between a cooperating pair of upper and lower paper plies 12 and 12A. The hinge 18 is provided by cutting with an appropriate cutting implement 30 only the upper paper ply 12 and only for the depth of the flutes 22, and thereby leaving intact the lower paper ply 12A.

To obtain the one-half size reduction in the game board 10, the cutting site 32 selected for the hinge 18 is centrally and laterally of the first or top paper ply 12. With the lower paper ply 12A left uncut or intact, the lower ply 12A along the traverse line 34 allows a game board pivotal traverse in closing or folding together movement depicted by the arrow 36 preparatory to providing the size-reduced game board 10 of FIG. 4 with hand grips 11, and also unfolding or opening movement as depicted by the arrow 38 preparatory to providing the full-sized game board 10 of FIG. 5.

In practice, it has been found advantageous to use a double ply corrugated cardboard construction in which, as best shown in FIG. 3, there is included a medial paper ply 40 interposed between the top and bottom paper plies 12 and 12A and, more particularly, between the flutes 22 extending in depending relation from these plies, but a single ply construction is also to be understood to be within the contemplated scope of the present invention.

Additionally, what has been denominated as a "game board" can also be a "lap board" serving as a work surface for a single user, wherein it would have a full size during use, and fold along a vertically oriented hinge as herein constructed into a half-size that would conveniently fit into the user's attache case or the like, and thereby have the requisite portability.

In the above and other respects, while the portable corrugated cardboard game board herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of embodying a hinge in a game board formed of corrugated cardboard construction material of a type having a first exterior paper ply and a second exterior paper ply adhesively secured on opposite sides to cusps of undulating paper flutes in an interposed position therebetween, said hinge-embodying method comprising the steps of die-cutting from a corrugated cardboard substrate a game board of a selected generally rectangular shape and of a size not less than 20 inches in width and 30 inches in length, designating said first exterior paper ply as a playing surface of said game board, selecting a site for a hinge extending centrally and laterally of said first exterior paper ply of said game board, cutting a slit through said first exterior paper ply and said flutes along said hinge site only to the depth of said second exterior paper ply so as to leave intact said second exterior paper ply to function as a hinge, whereby said game board is adapted to be used on the laps of players and urged about said uncut second exterior paper ply to permit closing movement of two halves of said second exterior ply towards each other so as to reduce the dimension thereof in half to contribute to the convenience in the transport thereof.

2. A method of embodying a hinge in a lap-supported board formed of corrugated cardboard construction material of a type having a first exterior paper ply and a second exterior paper ply adhesively secured on opposite sides to cusps of undulating paper flutes in an interposed position therebetween, said hinge-embodying method comprising the steps of die-cutting from a corrugated cardboard substrate a board of a selected generally rectangular shape, designating said first exterior paper ply as a work surface of said board, selecting a site for a hinge extending centrally of said first exterior paper ply of said board, cutting a slit through said first exterior paper ply and said flutes along said hinge site only to the depth of said second exterior paper ply so as to leave intact said second exterior paper ply to function as a hinge, whereby said board is adapted to be use on the laps of players and urged about said uncut second exterior ply to permit closing movement of two halves of said second exterior ply towards each other so as to reduce the dimension thereof in half to contribute to the convenience in the transport thereof.

* * * * *